US010890199B2

(12) United States Patent
Hahn et al.

(10) Patent No.: US 10,890,199 B2
(45) **Date of Patent: *Jan. 12, 2021**

(54) APPARATUS FOR RECUPERATING HYDRAULIC ENERGY WITH ENERGY-EFFICIENT REPLENISHMENT OF THE ROD SIDES OF DIFFERENTIAL CYLINDERS AND SIMULTANEOUS PRESSURE INTENSIFICATION

(71) Applicant: Liebherr-Mining Equipment Colmar SAS, Colmar (DE)

(72) Inventors: Philipp Hahn, Turckheim (FR); Volker Gliniorz, Breisach am Rhein (DE); Guillaume Bonnetot, Zimmersheim (FR)

(73) Assignee: Liebherr-Mining Equipment Colmar SAS, Colmar (FR)

( * ) Notice: Subject to any disclaimer, the term of this patent is extended or adjusted under 35 U.S.C. 154(b) by 75 days.

This patent is subject to a terminal disclaimer.

(21) Appl. No.: 15/624,570

(22) Filed: Jun. 15, 2017

(65) Prior Publication Data

US 2017/0363122 A1 Dec. 21, 2017

(30) Foreign Application Priority Data

Jun. 15, 2016 (DE) ..... 10 2016 007 286

(51) Int. Cl.
*F15B 21/14* (2006.01)
*F15B 1/02* (2006.01)
(Continued)

(52) U.S. Cl.
CPC ..... *F15B 21/14* (2013.01); *F15B 1/024* (2013.01); *F15B 1/033* (2013.01); *F15B 11/044* (2013.01); *F15B 11/16* (2013.01); *F15B 2211/20546* (2013.01); *F15B 2211/212* (2013.01); *F15B 2211/31541* (2013.01); *F15B 2211/31588* (2013.01); *F15B 2211/41581* (2013.01); *F15B 2211/46* (2013.01); *F15B 2211/50545* (2013.01); *F15B 2211/5159* (2013.01);
(Continued)

(58) Field of Classification Search
CPC ..... E02F 9/2217; F15B 2211/88; F15B 2211/20546; F15B 21/14; F15B 1/024; F15B 1/033; B66F 9/22
See application file for complete search history.

(56) References Cited

U.S. PATENT DOCUMENTS 7,634,911 B2 * 12/2009 Brinkman ..... E02F 9/2075 60/414
2009/0165450 A1 * 7/2009 Cherney ..... E02F 9/2203 60/413
2013/0318955 A1 * 12/2013 Zhang ..... E02F 9/2217 60/413

FOREIGN PATENT DOCUMENTS

DE 112013002784 T5 3/2015

* cited by examiner

*Primary Examiner* — Abiy Teka
(74) *Attorney, Agent, or Firm* — McCoy Russell LLP

(57) ABSTRACT

An apparatus for recuperating hydraulic energy in a working machine includes at least one first differential cylinder piston device with a differential cylinder and separate rod and bottom sides, and at least one hydraulic accumulator which is hydraulically connectable with the differential cylinder piston device. The potential energy of the differential cylinder piston device retracting under pressing load is at least partly storable in the hydraulic accumulator. The rod and bottom sides are connectable with each other via at least one brake valve for recirculating hydraulic fluid from the bottom side into the rod side.

17 Claims, 2 Drawing Sheets

(51) Int. Cl.
*F15B 1/033* (2006.01)
*F15B 11/044* (2006.01)
*F15B 11/16* (2006.01)

(52) U.S. Cl.
CPC . *F15B 2211/632* (2013.01); *F15B 2211/6306* (2013.01); *F15B 2211/6313* (2013.01); *F15B 2211/6336* (2013.01); *F15B 2211/6343* (2013.01); *F15B 2211/7053* (2013.01); *F15B 2211/71* (2013.01); *F15B 2211/7107* (2013.01); *F15B 2211/75* (2013.01); *F15B 2211/761* (2013.01); *F15B 2211/88* (2013.01)

APPARATUS FOR RECUPERATING HYDRAULIC ENERGY WITH ENERGY-EFFICIENT REPLENISHMENT OF THE ROD SIDES OF DIFFERENTIAL CYLINDERS AND SIMULTANEOUS PRESSURE INTENSIFICATION

CROSS REFERENCE TO RELATED APPLICATIONS

This application claims priority to German Patent Application No. 10 2016 007 286.5, entitled, "Apparatus for Recuperating Hydraulic Energy with Energy-Efficient Replenishment of the Rod Sides of Differential Cylinders and Simultaneous Pressure Intensification," filed Jun. 15, 2016, the entire contents of which is hereby incorporated by reference in its entirety for all purposes.

TECHNICAL FIELD

This present disclosure relates to an apparatus for recuperating hydraulic energy in a working machine, comprising at least one first differential cylinder piston device with a differential cylinder and separate rod and bottom sides, with at least one hydraulic accumulator which is hydraulically connectable with the differential cylinder piston device, wherein the potential energy of the differential cylinder piston device retracting under pressing load is at least partly storable in the hydraulic accumulator, and wherein the rod and bottom sides are connectable with each other via at least one brake valve for recirculating hydraulic fluid from the bottom into the rod side.

BACKGROUND AND SUMMARY

In known interconnections of hydraulic cylinders especially in mobile working machines, the retraction of hydraulic cylinders under pressing load, e.g. when the or a lifting cylinder is lowered without pressure, is realized by a throttle control. Here, the potential energy which is defined by the load acting on the cylinder is converted into heat by throttling the pressurized volume flow. The existing potential energy thereby is destroyed. Due to the conversion into heat, cooling capacity additionally must be applied within the machine.

A commonly used type of the hydraulic cylinders in mobile working machines is the differential cylinder. When the same is retracted by means of throttle control and pressing load, it must be ensured that a replenishment of the rod-side cylinder chamber is ensured. On the one hand, this is possible by adding a corresponding supply volume flow through the working pumps, and on the other hand a corresponding replenishment of the rod-side cylinder chambers can be carried out by recirculating the throttled volume flow. Due to the recirculation of the throttled volume flow a division of this volume flow corresponding to the area ratio of the hydraulic cylinders or corresponding to the area ratio of rod and bottom side of the hydraulic cylinder or the hydraulic cylinders is made. A part of the volume flow here flows into the rod-side chambers of the cylinders, the other part is guided into the tank.

When the potential energy contained in the lowering operation of the lifting cylinders is to be stored, it is important to store as much of the existing energy as possible. In hydraulics, this corresponds to an oil quantity as large as possible under a pressure as high as possible. The hydraulic interconnections known from the prior art, which realize the recirculation of a part of the bottom-side volume flow into the rod-side chambers of the hydraulic cylinders, reduce the volume flow which can be available for storage.

Currently, different solutions for storing the potential energy when lowering the boom of mobile hydraulic working machines are known. For example apparatuses are known, in which one of two cylinders is used for storing energy. There is used a displacement machine in a closed circuit, in order to replenish the rod-side chambers of both cylinders with the return flow quantity of the second cylinder. A disadvantage of this kind of apparatuses is the non-existent exchange of oil on the bottom side of the hydraulic cylinder which is connected with the accumulator. The oil volume only is moved between hydraulic accumulator and bottom side of the cylinder.

There are also known apparatuses in which on retraction of the cylinders a hydraulic pump is used, in order to ensure the replenishment of the rod-side chambers. Replenishment by application of hydraulic power does not correspond to an energy-efficient actuation of the hydraulic consumers.

The absorption of the potential energy of the boom by a gas-filled cylinder likewise is known. In use of such apparatuses the additional integration of a gas cylinder into the machine is necessary, which means a disadvantageously high integration expenditure. In addition, the storage volume of the gas storage cylinder must be designed for the entire stroke of the drive, even if the entire stroke is not employed in normal working use.

For feeding in the stored hydraulic energy, apparatuses are known in which the energy is directly fed into the fan circuit of the machine. Based on the operating point of the fan circuit it is necessary to throttle the supplied volume flow from the hydraulic accumulator to the fan circuit. There are caused throttling losses, and the quantity of the reusable hydraulic energy thus is reduced.

It furthermore is known to use the stored hydraulic energy directly for supplying the working pumps. This requires a circuitry which connects the suction side of the working pump either with the hydraulic tank or with the hydraulic accumulator. When the pump is not supplied via the hydraulic accumulator, pressure losses occur through the valve, which influence the intake pressure of the pump and thus can cause unfavorable operating conditions. In addition, cooling and filtering must be provided between hydraulic accumulator and intake of the working pump.

The known hydraulic interconnections correspondingly have three disadvantages:

The potential energy of the lifting-lowering operation is destroyed by the throttling operation and cannot be used for other processes.

The potential energy of the lifting-lowering operation is introduced into the hydraulic system in the form of thermal energy and subsequently must be dissipated again by corresponding cooling devices. These operations likewise are consuming energy.

The division of the bottom-side volume flow on lowering of the lifting cylinders leads to a reduction of the possible potential of storable energy.

It therefore is the object of the present disclosure to store the potential energy, which is defined by the pressing load on the hydraulic cylinder(s), and at the same time ensure an energy-efficient replenishment of the rod-side chambers of the hydraulic cylinders.

According to the present disclosure, this object is solved by an apparatus for recuperating hydraulic energy in a working machine having an apparatus with at least one first differential cylinder piston device with a differential cylinder and separate rod and bottom sides, which furthermore comprises at least one hydraulic accumulator which is hydraulically connectable with the differential cylinder piston device. The apparatus is formed such that the potential energy of the differential cylinder piston device retracting under pressing load is at least partly storable in the hydraulic accumulator, and that the rod and bottom sides are connectable with each other via at least one brake valve for recirculating hydraulic fluid from the bottom into the rod side.

Advantageously, the potential energy withdrawn from the differential cylinder piston device initially can be stored and in a further state of the apparatus be used for operating the working machine. The quantity of the storable potential energy thereby is maximized, which can be used for other tasks within the working machine. Furthermore, the expended cooling capacity can be reduced, as less waste heat must be dissipated by the cooling system within the machine. Based thereon, the entire operation of the hydraulic working machine can be made more energy-efficient.

In an embodiment of the present disclosure it is conceivable that the hydraulic accumulator is hydraulically connectable with more than the one differential cylinder piston device. Accordingly, it can be provided that further differential cylinder piston devices of the working machine release the potential energy contained in them to the at least one hydraulic accumulator. Accordingly, it is conceivable that for better energy recovery different differential cylinder piston devices of a working machine are coupled with the hydraulic accumulator or the hydraulic accumulators. Correspondingly, an increased energy recuperation rate can be achieved.

In another embodiment it is conceivable that a support motor is provided, which is designed to feed the hydraulic energy stored in the hydraulic accumulator into a drive train of the working machine and thereby recuperate the same, wherein the support motor in particular is connectable with the hydraulic accumulator via a support motor valve. Advantageously, the energy stored in the hydraulic accumulator thus can be used to support a primary drive source such as a diesel engine or an electric motor of the working machine, in that energy can be fed into the drive train of the machine via the support motor.

In another embodiment it is conceivable that the differential cylinder piston devices are arranged to be operated in parallel. In another embodiment it can furthermore be provided that at least one working pump is provided for driving the differential cylinder piston device and/or that at least one control slide valve is provided for actuating the differential cylinder piston device and/or that at least one tank is provided and/or that a hydraulic accumulator valve is provided for shutting off the hydraulic accumulator against the differential cylinder piston device. The advantages of said formations can be taken from the description of the Figures.

In another embodiment it is conceivable that a connecting valve is provided for shutting off the bottom side against the rod side of the differential cylinder piston device. It also is conceivable that by shutting off the bottom side against the rod side a pressure intensification takes place and/or that the hydraulic accumulator is connectable with the rod side of the differential cylinder.

The present disclosure furthermore is directed to a working machine, in particular to a wheel loader, hydraulic excavator or crane, comprising an apparatus for recuperating hydraulic energy. Optionally, it can be provided that the working machine is equipped to be operable without loss of further functions in the case of a failure of the apparatus for recuperating hydraulic energy. For example, further functions may refer to any hydraulic functions of the working machine 1, such as operations of the hydraulic actuators and the corresponding operations of the valves, pumps and motors.

Accordingly, the apparatus for recuperating hydraulic energy can be provided as merely an additional apparatus on the working machine, wherein even without the apparatus according to the present disclosure the working machine is provided with all actuators necessary for the operation of the working machine. The apparatus according to the present disclosure thus can be retrofitted in working machines known per se, wherein the functionality of the working machines does not depend on the apparatus.

Further details and advantages of the present disclosure are described with reference to the Figures.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
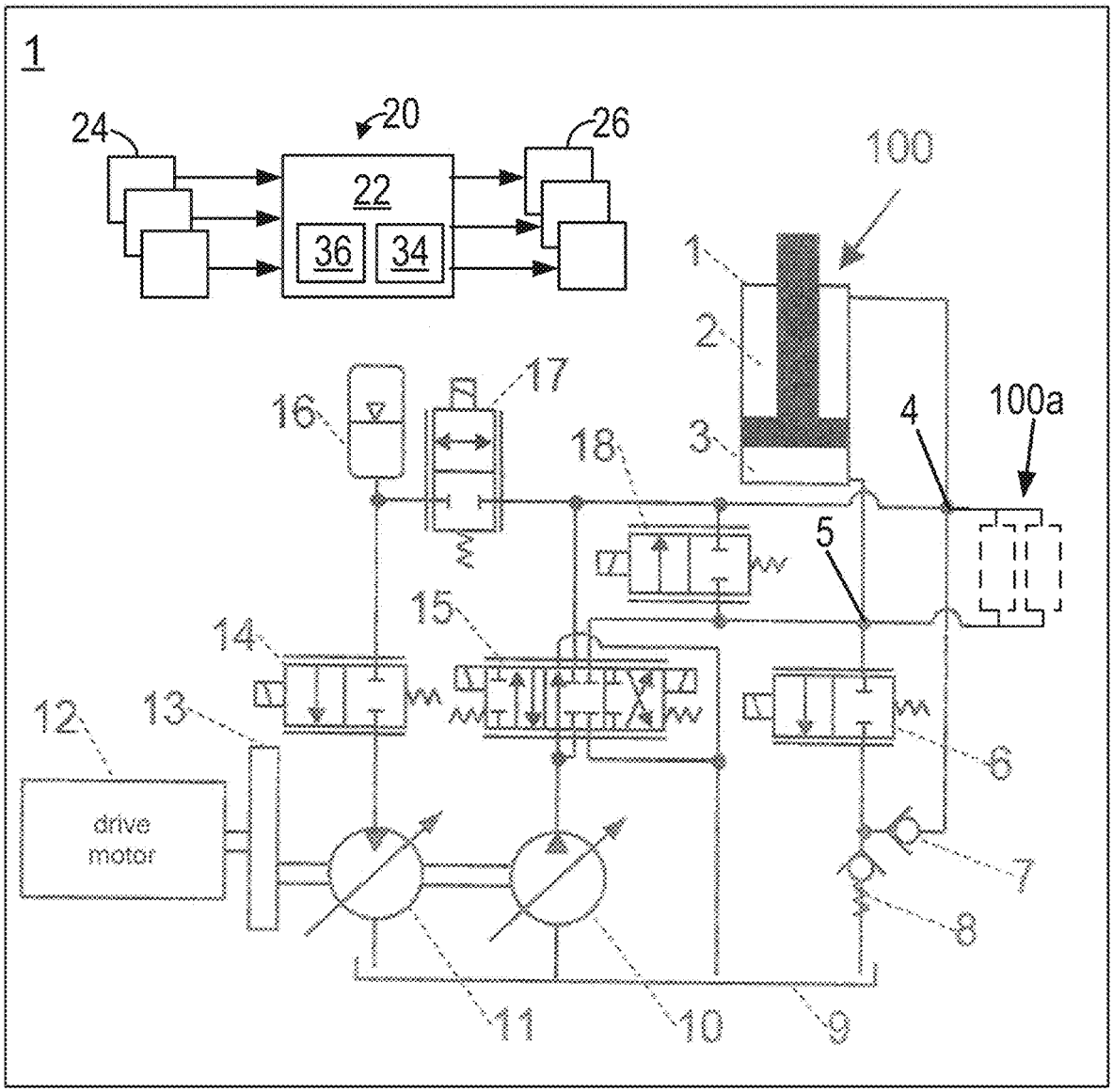
FIG. 1 schematically shows an exemplary working machine comprising a hydraulic circuit in accordance with the present disclosure.

FIG. 1 schematically shows a working machine 1 comprising a hydraulic circuit and a control system 20. In some examples, working machine 1 may be a wheel loader, a hydraulic excavator or a crane. In the depicted example, the hydraulic circuit comprises a differential cylinder piston device 100; optional additional differential cylinder piston devices 100*a*, which are connected in parallel with differential cylinder piston device 100, are shown in broken lines. In particular, the optional additional differential cylinder piston devices can be integrated into the system at rod-side port 4 and bottom-side port 5, as shown. While two additional differential cylinder piston devices 100 are shown in FIG. 1, the hydraulic circuit may alternatively include only one differential cylinder piston device total, two differential cylinder piston devices, three differential cylinder piston devices (as shown in FIG. 1), or another number of differential cylinders without departing from the scope of this disclosure.

Each differential cylinder piston device 100 includes a retractable piston comprising a piston rod and a piston head inside the differential cylinder. The piston head separates a bottom side chamber 3 from a rod side chamber 2 of the differential cylinder. In the depicted example, the hydraulic circuit further comprises a hydraulic accumulator 16, hydraulic accumulator valve 17, connecting valve 18, hydraulic motor support valve 14, control slide valve 15, brake valve 6, check valve 7, preloading valve 8, drive motor 12, transfer gear 13, support motor 11, working pump 10, and tank 9.

In the depicted example, control system 20 includes a control unit 22 communicating with sensors 24 and actuators 26. Control unit 22 includes a processor 34 and non-transitory memory 36, the non-transitory memory having instructions stored therein for carrying out the various control actions described herein, including control actions associated with the method shown in FIG. 2. Control unit 22 receives signals from sensors 24 and sends signals to actuators 26 to adjust operation of the various components of the hydraulic circuit, such as the differential cylinder piston device(s), hydraulic accumulator, and various valves, motors, and pumps, based on the received signals and the instructions and other data stored in the non-transitory memory 36.

Sensors 24 may include, for example, pressure sensors which are arranged in the hydraulic accumulator, in the bottom side chamber of the differential cylinder, in the upper (rod side) chamber of the differential cylinder, and/or in one or more of the various hydraulic lines connecting the components of the hydraulic circuit. Other types of sensors such as flow rate sensors, temperature sensors, etc. may optionally be included in one or more of these locations as well.

Actuators 26 may include, for example, actuators for the hydraulic accumulator valve 17, connecting valve 18, hydraulic support motor valve 14, control slide valve 15, brake valve 6, preloading valve 8, hydraulic accumulator 16, drive motor 12, support motor 11, transfer gear 3, and working pump 10. In other examples, actuators 26 may include mechanical actuators, pneumatic actuators, thermal actuators, and the like.

When a working machine with an apparatus according to the present disclosure is put into operation, a corresponding preloading pressure may be applied in the hydraulic accumulator 16. For example, hydraulic accumulator 16 may be a hydro-pneumatic accumulator in which the preloading pressure is generated through compressed gas and/or a compressed spring within the hydraulic accumulator. When the storage operation is to be started, an external force must be applied at the differential cylinder 1 or at the corresponding piston, which leads to retraction. In the schematic view shown in FIG. 1, retraction of the piston refers to downward movement of the piston towards the bottom of the cylinder. The external force applied may include a mechanical pressing load on the piston, for example, which may result from the weight of objects transported by the working machine acting on the piston. As a result, pressures are built up on the bottom side 3 of the differential cylinder 1, which define the existing potential energy. This potential energy is to be absorbed by the hydraulic accumulator 16. To start the lowering operation of the piston, the hydraulic accumulator valve 17 is opened and thus a connection between the hydraulic accumulator 16 and the rod side 2 of the differential cylinder 1 is created. The hydraulic accumulator valve 17 can be an electronically-controlled 2-way valve, for example, and the control unit may send a signal to the hydraulic accumulator valve to open the valve in response to a request to start the lowering operation. To initiate the retracting movement of the differential cylinder 1, the connecting valve 18 is actuated. The actuation of the connecting valve 18 creates a fluid connection between bottom side 3 and rod side 2 of the differential cylinder 1. Through the connecting valve 18 the volume flow gets from the bottom side 3 into the rod side 2 of the differential cylinder. Based on the area ratio between bottom side 3 and rod side 2 not the entire volume can be absorbed by the rod side 2. The differential volume, which is guided through the hydraulic accumulator valve 17, is absorbed by the hydraulic accumulator 16.

The connecting valve may be an electronically-controlled proportional valve having an adjustable opening area, such as an electronically-controlled throttle valve. For example, the control unit may send a signal to an actuator of the connecting valve to adjust the opening area of the connecting valve to a desired opening area. The desired opening area may be determined by the control system based on a desired speed of retraction of the differential cylinder under load, for example. In some examples, the desired speed of retraction of the differential cylinder may be determined by the displacement/deflection of a manually operated control lever (e.g., a control lever of the working machine which is manually operated by a crane operator), wherein a signal reflecting the displacement/deflection of the control lever is sent from the control lever to the control unit, and the control unit in turn determines a the desired speed of retraction based on the signal and optionally based on other parameter values associated with the hydraulic system. Based on the opening area of the connecting valve 18 and the related throttling of the oil volume flow from the bottom side 3 of the differential cylinder 1, the speed of retraction of the differential cylinder 1 under load can be influenced. When the retracting movement of the differential cylinder 1 is to be stopped, the connecting valve 18 and the hydraulic accumulator valve 17 are closed (e.g., the control unit sends signals to valves 18 and 17 to close). By closing the hydraulic accumulator valve 17, the hydraulic accumulator 16 is shut off and the hydraulic energy absorbed remains stored in the hydraulic accumulator 16.

After the storage operation, the energy of the pressurized oil volume in the hydraulic accumulator 16 can again be fed into the drive train of the machine. For this purpose, the support motor 11 is connected with the hydraulic accumulator 16 via the hydraulic support motor valve 14 (e.g., the control unit sends a signal to the hydraulic support motor valve 14 to fluidly connect the support motor 11 with the hydraulic accumulator 16). The support motor 11 can be mounted directly on the transfer gear 13 of the machine and is operated with a speed imparted by the drive motor 12. Depending on the absorption volume of the support motor 11 energy then is fed into the drive train of the machine, corresponding to the operating conditions of the hydraulic accumulator 16. Upon completion of the feeding operation the support motor valve 14 is closed and the fluid connection between hydraulic accumulator 16 and support motor 11 thus is separated.

The hydraulic accumulator 16 can be designed for the entire stroke path of the differential cylinder or only for a part of the stroke path of the differential cylinder 1. When the hydraulic accumulator 16 is designed only for a part of the stroke path of the differential cylinder 1 and a retracting movement of the differential cylinder 1 is to be effected beyond the design limit of the hydraulic accumulator 16, the connecting valve 18 and the hydraulic accumulator valve 17 are closed and the brake valve 6 is actuated wherein actuation of brake valve 6 may occur responsive to pressure in the hydraulic accumulator being greater than a threshold (e.g., sensor 24 may send a signal to the control unit when the hydraulic accumulator pressure exceeds a threshold and in response, the control unit may send a signal to the actuator of brake valve 6 to fluidly connect the bottom side of the differential cylinder to the rod side of the differential cylinder via check valve 7). Through the brake valve 6 of the differential cylinder 1 a part of the volume flow from the bottom side 3 of the differential cylinder 1 gets through the check valve 7 to the rod side 2 of the differential cylinder 1 at a preloading pressure which is specified by the preloading valve 8. A lack of filling on the rod side 2 of the differential cylinder 1 during the retracting movement thereby is prevented. The volume flow from the bottom side 3 of the differential cylinder 1, which is not absorbed by the rod side 2 of the differential cylinder 1, gets into the tank 9 via the preloading valve 8.

When in the working cycle of the machine an extending or retracting movement of the differential cylinder 1 subsequently is effected by a corresponding actuation of the working pump 10 and the control slide valve 15, the connecting valve 18 and the hydraulic accumulator valve 17 are kept closed. The inflow and outflow of the volume flows of the differential cylinder 1 then is effected corresponding to the interconnection of the control slide valve 15. While FIG. 1 depicts a single working pump 10 and a single control slide valve 15, the hydraulic circuit may alternatively include a plurality of working pumps 10 and/or a plurality of control slide valves 15.

As hydraulic accumulator 16, all kinds of hydraulic accumulators can be used, with different energy storage media, e.g. nitrogen. Designs in which the hydraulic accumulator is a hydro-pneumatic accumulator, bladder accumulator, piston accumulator, diaphragm accumulator or spring accumulator, as well as different combinations of accumulator designs, are conceivable.

The valves shown are usable as individual 2/2-way valves, or also in combination on a valve rod. A proportional or switching actuation of the valves also is possible. In principle, the valves may be in any of the possible positions shown in FIG. 1. In one operating mode, the valves may be controlled to states which allow hydraulic energy to accumulate in hydraulic accumulator 16 when an external pressing load is acting on the piston. In another operating mode, the valve states may be selected such that energy from hydraulic accumulator 16 and/or drive motor 12 is provided to the differential cylinder piston device. In yet another operating mode, the hydraulic motor support valve 14 and hydraulic accumulator valve 17 may be set such that hydraulic accumulator 16 runs drive motor 12, assisting to drive working pump 10 and therefore indirectly assisting to drive the differential cylinder piston device 100.

Figure 2:
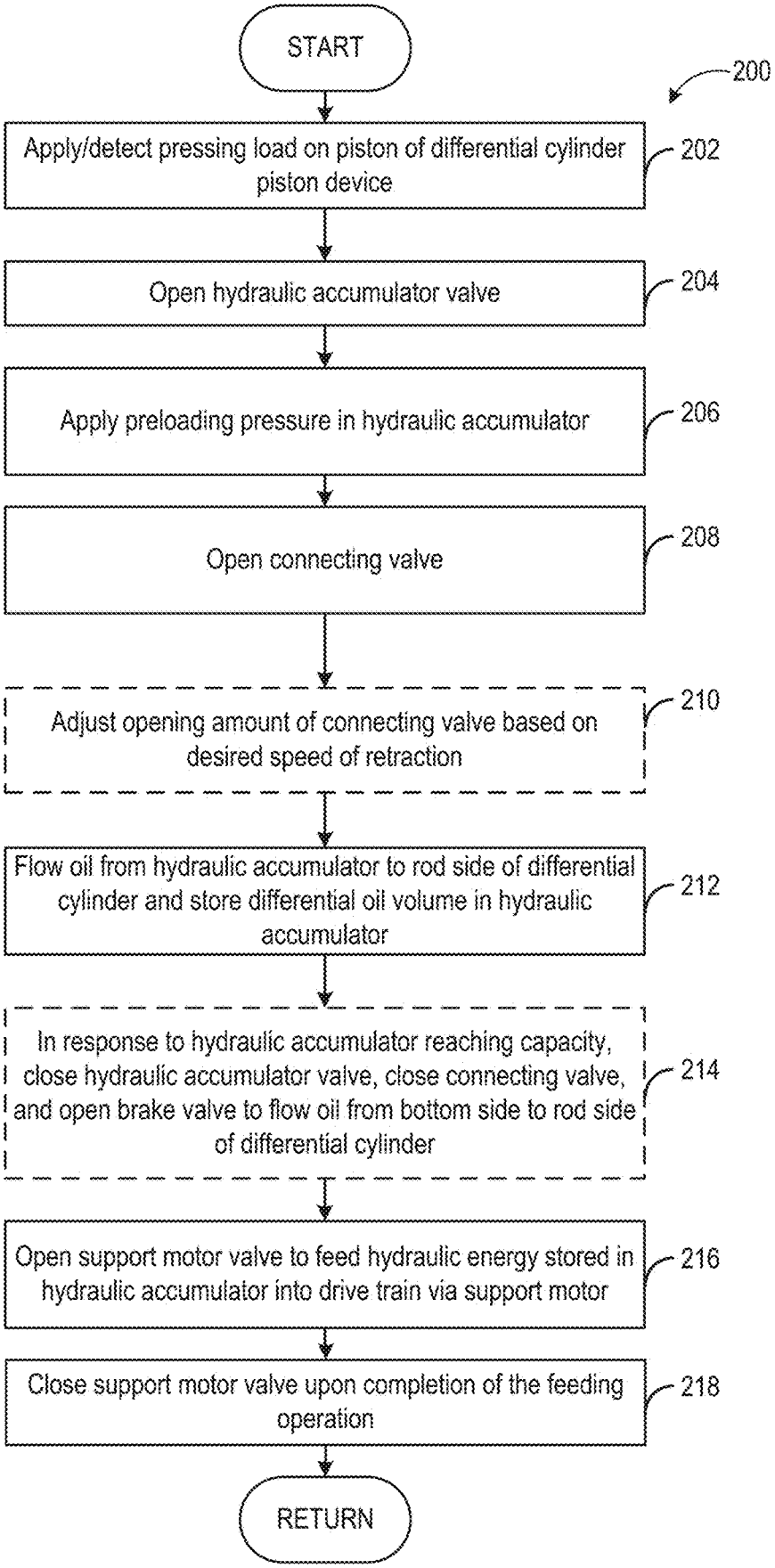
FIG. 2 is a flowchart illustrating an exemplary method for operating a hydraulic circuit of a working machine in accordance with the present disclosure.

Referring now to FIG. 2, an exemplary method 200 for operation of the hydraulic circuit of the work machine is shown. Instructions for carrying out method 200 may be executed by control system 20 based on instructions stored in a memory such as memory 36 and in conjunction with signals received from various sensors such as sensors 24 of work machine 1. While FIG. 2 refers to a single differential cylinder piston device and a single hydraulic accumulator, the method can equally be applied in hydraulic circuits with multiple differential cylinder piston devices and/or multiple hydraulic accumulators.

At 202, the method includes applying a pressing load to a piston of the differential cylinder piston device. For example, the pressing load may be generated by a hydraulic cylinder of the working machine being retracted under a pressing load, such as when the working machine lowers its loaded boom. The sensors of the control system may sense the pressing load on the piston and send a signal to the control unit for example.

At 204, the method includes opening the hydraulic accumulator valve. For example, the control unit may send a signal to an actuator of the hydraulic accumulator valve to open the valve, such that the hydraulic accumulator may fluidly communicate with the rod side of the differential cylinder.

At 206, the method includes applying a preloading pressure at the hydraulic accumulator. For example, the control unit may send a signal to an actuator of the hydraulic accumulator to generate the preloading pressure through compressed gas and/or a compressed spring within the hydraulic accumulator.

At 208, the method includes opening (e.g., fully or partially opening) the connecting valve. For example, the control unit may send a signal to an actuator of the connecting valve to open the connecting valve, thereby fluidly connecting the bottom side of the differential cylinder with the rod side of the differential cylinder, as well as fluidly connecting the bottom side of the differential cylinder with the hydraulic accumulator (in the open state of the hydraulic accumulator valve).

At 210, the method optionally includes adjusting an opening amount of the connecting valve based on a desired speed of retraction of the piston of the differential cylinder piston device. For example, the connecting valve may be an electronically-controlled throttle valve, and the control unit may send a signal to an actuator of the connecting valve to adjust the connecting valve to a desired opening amount corresponding to the desired speed of retraction.

At 212, the method includes flowing oil from the hydraulic accumulator to the rod side of the differential cylinder, and storing the differential oil volume in the hydraulic accumulator. With the connecting valve and hydraulic accumulator valve open, the hydraulic accumulator, the rod side of the differential cylinder, and the bottom side of the differential cylinder are in fluid communication, leading to intensification of pressure at both the rod side and bottom side of the cylinder.

At 214, the method optionally includes, in response to the hydraulic accumulator reaching capacity, closing the hydraulic accumulator valve and the connecting valve, and opening the brake valve. Opening the brake valve provides a further fluid connection between the bottom side of the differential cylinder and the rod side of the differential cylinder, where the pressure of oil flowing into the rod side after flowing from the bottom side through the brake valve is dictated by a preloading pressure of preloading valve 8. As used herein, the hydraulic accumulator reaching capacity refers to the pressure in the hydraulic accumulator reaching a maximum pressure, such that no further oil can be stored in the hydraulic accumulator. One or more sensors arranged in the hydraulic circuit, such as pressure sensors, may send signals to the control unit which enable the control unit to determine whether the hydraulic accumulator has reached capacity.

In some examples, the hydraulic accumulator may have a capacity which is large enough to store oil during a full retraction of the piston of the differential cylinder, without the need to bleed off pressure by opening the brake valve. In other examples, however, the capacity of the hydraulic accumulator may only be large enough to store oil during a partial retraction of the piston, and thus opening the brake valve enables further retraction of the piston to be performed.

At 216, the method includes opening the support motor valve to feed hydraulic energy stored in the hydraulic accumulator into the drive train of the working vehicle via the support motor.

At 218, the method includes closing the support motor valve upon completion of the feeding operation. After 218, the method returns.

While method 200 depicts operation of the hydraulic circuit in which the rod and bottom sides of the differential cylinder are connected, during certain operating conditions the bottom and rod sides may not be connected, and the piston may be extended/retracted via the working pump and control slide valve. Thus, depending on operating conditions, the piston may be extended/retracted via the working pump and control slide valve and additionally or alternatively via connecting the bottom and rod sides with the hydraulic accumulator. The relevant operating conditions may be the energy content of the hydraulic accumulator and the desired speed of retraction of the piston. For example, during an operating mode where the energy content of the accumulator 16 is high (e.g., above a predetermined threshold) and the extension/retraction of the piston provides energy into the system from an external force/pressing load acting on the differential cylinder piston device, than no further energy may be input into the hydraulic accumulator and depending on the desired speed of retraction, the piston may be extended/retracted via the working pump or without even the working pump and only as a result of the external force/pressing load. In contrast, during a different operating mode in which the hydraulic accumulator contains a sufficient amount of energy and energy needs to be transferred to (e.g., work effected by) the differential cylinder piston device, then the hydraulic accumulator alone, or if e.g. greater speeds are required, the hydraulic accumulator in combination with the working pump, may provide energy to the piston. Therefore, the control system may send signals to actuators of the valves and other components of the circuit to hydraulically connect or disconnect the working pump, support motor pump, hydraulic accumulator, rod side of the differential cylinder, bottom side of the differential cylinder, and fuel tank depending on operating conditions such as the energy content of the hydraulic accumulator (e.g., hydraulic pressure stored therein) and the desired speed of retraction of the piston.

Operation of a hydraulic circuit of a working machine in accordance with the method of FIG. 2 may advantageously allow for recuperation of hydraulic energy from the weight of objects (e.g., objects transported by the working machine) acting on the piston.

The present disclosure is characterized in that one or more differential cylinder piston devices 100 can be retracted under pressing load and the existing potential energy thereby can be stored for a large part by means of one or more hydraulic accumulators 16. The differential cylinder piston devices 100 can be designated as hydraulic linear drives. The term cylinder or differential cylinder can relate to the differential cylinder piston device of the present disclosure depending on the context and in a manner which is obvious for the skilled person.

The present disclosure furthermore is characterized in that one or more differential cylinders can be retracted under pressing load and filling of the rod sides of the cylinders is effected at a high pressure level. During the retracting operation, a connection between bottom and rod side of the one or more differential cylinders is created via a valve. The bottom-side pressure thereby is applied on the rod side. Based on the area ratios a pressure intensification is produced, which leads to an increase of the bottom-side pressure. At the same time, one or more hydraulic accumulators are connected with the rod sides of the differential cylinders during the retracting operation. By throttling the connection between bottom and rod side of the differential cylinders a control of the speed can be performed. The difference in volume between bottom- and rod-side chamber of the differential cylinders is absorbed by the one or more hydraulic accumulators. Due to the small pressure difference between bottom and rod side of the differential cylinders only a small part of the potential energy is converted into heat and thus more energy is available for storage.

The present disclosure furthermore is characterized in that the hydraulic linear drive can be retracted and extended without the one or more hydraulic accumulators and hydraulic valves having to be activated for storing the potential energy. This is achieved within the hydraulic circuit by a corresponding parallel interconnection of the hydraulic linear drive.

The present disclosure furthermore is characterized in that the storage of energy is possible on the entire or only on a part of the possible travel path of the differential cylinder.

The present disclosure is characterized in that the stored energy of the lowering operation of the one differential cylinder or of the several differential cylinders can be reused. This can be achieved in that a hydraulic motor can be connected with the corresponding hydraulic accumulator and the energy contained in the hydraulic accumulator can be fed into the drive train of the machines to support the primary drive source such as for example a diesel engine or an electric motor of the working machine.

The present disclosure also is characterized in that it can be integrated into the drive train of a machine without influencing the functions of the drive train such that the complete operability of the machine depends on the present disclosure. This means that the machine can properly be operated also without the operability of the present disclosure.

Note that the example control and estimation routines included herein can be used with various system configurations. The control methods and routines disclosed herein may be stored as executable instructions in non-transitory memory and may be carried out by the control system including the control unit in combination with the various sensors, actuators, and other hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the control system, where the described actions are carried out by executing the instructions in a system including the various components in combination with the control system.

The invention claimed is:

1. An apparatus for recuperating hydraulic energy in a working machine, comprising:

at least one first differential cylinder piston device with a differential cylinder having a separate rod side and a bottom side;

at least one hydraulic accumulator which is hydraulically connectable with the first differential cylinder piston device and which, via an accumulator valve fluidically coupled with the rod side of the differential cylinder, stores at least a part of a potential energy of the first differential cylinder piston device retracting under pressing load, wherein the accumulator valve is in direct fluid communication with the rod side of the differential cylinder;

a brake valve and a check valve housed in a second loop fluidically coupling the rod side of the differential cylinder and the bottom side of the differential cylinder; and a connecting valve housed in a first loop fluidically connecting the rod side and the bottom side of the differential cylinder for recirculating hydraulic fluid from the bottom side into the rod side of the differential cylinder with each of the brake valve, the check valve, and the accumulator valve open and closed.

2. The apparatus according to claim 1, wherein the hydraulic accumulator is hydraulically connectable with more than one differential cylinder piston device, each of the differential cylinder piston devices having a differential cylinder with a respective rod side and a respective bottom side, and wherein the accumulator valve is in direct fluid communication with the respective rod side of each differential cylinder.

3. The apparatus according to claim 2, wherein the differential cylinder piston devices are arranged to be operated in parallel, and wherein each of the differential cylinders are hydraulically connected to each other in parallel so that each of the respective rod sides of each differential cylinder are fluidically coupled with one another and each of the respective bottom sides of each differential cylinder are fluidically coupled with one another.

4. The apparatus according to claim 1, wherein a support motor is provided, which is designed to feed the hydraulic energy stored in the hydraulic accumulator into a drive train of the working machine and thereby recuperate the hydraulic energy, and wherein the support motor is connectable with the hydraulic accumulator via a support motor valve.

5. The apparatus according to claim 1, wherein at least one working pump is provided for driving the first differential cylinder piston device, at least one control slide valve is provided for actuating the first differential cylinder piston device, and at least one tank is provided, and a hydraulic accumulator valve is provided for shutting off the hydraulic accumulator against the differential cylinder piston device.

6. The apparatus according to claim 5, wherein the connecting valve is housed in the first loop fluidically coupling the rod side of the differential cylinder and the bottom side of the differential cylinder, the connecting valve provided for shutting off the bottom side against the rod side of the differential cylinder when the brake valve is closed.

7. The apparatus according to claim 6, wherein, by shutting off the bottom side against the rod side of the differential cylinder, a pressure intensification takes place.

8. The apparatus according to claim 1, wherein the hydraulic accumulator is connectable with the rod side of the differential cylinder.

9. A working machine, comprising:

an apparatus for recuperating hydraulic energy in the working machine, the apparatus comprising at least one first differential cylinder piston device with a differential cylinder having a separate rod side and a bottom side, and at least one hydraulic accumulator which is fluidly connectable with the first differential cylinder piston device via a hydraulic accumulator valve fluidically coupled with the rod side of the differential cylinder;

wherein potential energy of the first differential cylinder piston device retracting under a pressing load is at least partly storable in the hydraulic accumulator, and wherein the accumulator valve is in direct fluid communication with the rod side of the differential cylinder;

wherein the rod side and the bottom side of the differential cylinder are fluidly connectable with each other via a brake valve and a check valve housed in a second loop; and wherein the rod side and the bottom side of the differential cylinder are further fluidly connectable with each other via a connecting valve housed in a first loop for recirculating hydraulic fluid from the bottom side into the rod side of the differential cylinder with each of the brake valve, the check valve, and the hydraulic accumulator valve open and closed, the second loop at least partially overlapping with the first loop.

10. The working machine according to claim 9, wherein the working machine is equipped to be operable in a case of a failure of the apparatus for direct recuperation of hydraulic energy.

11. The working machine according to claim 9, further comprising a control unit having non-transitory memory with instructions stored therein, the instructions executable by a processor to:

during application of the pressing load on the first differential cylinder piston device, fluidly connect the hydraulic accumulator with the rod side of the differential cylinder by opening the hydraulic accumulator valve, and fluidly connect the bottom side of the differential cylinder with the rod side of the differential cylinder by opening the connecting valve.

12. The working machine according to claim 11, wherein the instructions further comprise instructions executable by the processor to:

determine a desired speed of retraction of a piston of the differential cylinder piston device; and adjust an opening amount of the connecting valve based on the desired speed of retraction.

13. A method for recuperating hydraulic energy in a working machine, comprising:

applying a preloading pressure at a hydraulic accumulator;

opening a hydraulic accumulator valve fluidically coupled with a rod side of a differential cylinder to fluidly connect the hydraulic accumulator with the rod side of the differential cylinder, wherein the accumulator valve is in direct fluid communication with the rod side of the differential cylinder;

retracting a piston by opening an electronically-controlled connecting valve to fluidly connect a bottom side of the differential cylinder with the rod side of the differential cylinder and the hydraulic accumulator, the connecting valve having an actuator responsive to an electronic signal from a control unit to move the connecting valve between open and closed positions to control fluid flow therethrough; and in response to the hydraulic accumulator reaching a threshold pressure, closing each of the connecting valve and the hydraulic accumulator valve and opening a brake valve fluidically coupling the bottom side with the rod side of the differential cylinder to circulate an amount of hydraulic fluid from the bottom side to the rod side of the differential cylinder via the brake valve and a check valve at a preloading pressure of a preloading valve.

14. The method in accordance with claim 13, wherein the amount of hydraulic fluid circulated from the bottom side to the rod side of the differential cylinder is based on an area ratio between the bottom side and the rod side of the differential cylinder.

15. The method in accordance with claim 13, wherein a differential amount of hydraulic fluid not absorbed at the rod side of the differential cylinder is stored in the hydraulic accumulator.

16. The method in accordance with claim 13, further comprising adjusting an opening area of the connecting valve to throttle a flow of hydraulic fluid from the bottom side to the rod side of the differential cylinder based on a desired retraction speed of the piston.

17. The method in accordance with claim 13, further comprising, after retracting the piston, closing the connecting valve and the hydraulic accumulator valve, opening a support motor valve to fluidly connect the hydraulic accumulator with a support motor, and feeding hydraulic energy stored in the hydraulic accumulator into a drive train of the working machine via the support motor.

* * * * *